US009499987B2

(12) United States Patent
Horton

(10) Patent No.: US 9,499,987 B2
(45) Date of Patent: Nov. 22, 2016

(54) ROOFING SYSTEMS FOR LOW SLOPE MEMBRANE AND STEEP PITCH METAL ROOFING

(71) Applicant: Southeastern Metals Manufacturing Company, Inc., Jacksonville, FL (US)

(72) Inventor: James W. Horton, Yulee, FL (US)

(73) Assignee: Southeastern Metals Manufacturing Company, Inc.

( * ) Notice: Subject to any disclaimer, the term of this patent is extended or adjusted under 35 U.S.C. 154(b) by 0 days.

(21) Appl. No.: 14/970,654

(22) Filed: Dec. 16, 2015

(65) Prior Publication Data

US 2016/0208493 A1 Jul. 21, 2016

Related U.S. Application Data

(60) Provisional application No. 62/093,338, filed on Dec. 17, 2014, provisional application No. 62/119,287, filed on Feb. 23, 2015.

(51) Int. Cl.

| | |
|---|---|
| ***E04D 5/14*** | (2006.01) |
| ***E04D 13/00*** | (2006.01) |
| ***E04D 11/02*** | (2006.01) |
| ***E04D 15/04*** | (2006.01) |
| ***E04D 3/36*** | (2006.01) |
| ***E04D 3/16*** | (2006.01) |

(52) U.S. Cl.

CPC ..... *E04D 5/148* (2013.01); *E04D 3/16* (2013.01); *E04D 3/3605* (2013.01); *E04D 5/142* (2013.01); *E04D 5/143* (2013.01); *E04D 5/145* (2013.01); *E04D 5/146* (2013.01); *E04D 11/02* (2013.01); *E04D 13/00* (2013.01); *E04D 15/04* (2013.01); *E04D 2015/045* (2013.01)

(58) Field of Classification Search

CPC . E04D 12/002; E04D 15/06; E04D 13/1618; E04D 13/1625; E04D 1/26; E04D 5/10; E04D 5/12; E04D 5/142; E04D 11/02

USPC ..... 52/105, 409, 528; 156/59, 760, 71; 206/397, 410, 411, 412

See application file for complete search history.

(56) References Cited

U.S. PATENT DOCUMENTS

| | | | | | |
|---|---|---|---|---|---|
| 1,965,972 | A | * | 7/1934 | Balph | E04D 11/02 52/516 |
| 2,122,747 | A | * | 7/1938 | Kirschbraun | E04D 5/12 52/416 |
| 4,233,791 | A | * | 11/1980 | Kuhl | E04B 1/66 156/71 |
| 4,346,543 | A | * | 8/1982 | Wilson | E04D 3/3602 52/404.2 |
| 4,570,396 | A | | 2/1986 | Struben | |
| 4,736,552 | A | * | 4/1988 | Ward | E04B 1/642 52/309.13 |
| 4,864,781 | A | | 9/1989 | Emblin | |
| 5,365,709 | A | * | 11/1994 | Lassiter | D06N 5/00 156/92 |

(Continued)

*Primary Examiner* — Rodney Mintz

(74) *Attorney, Agent, or Firm* — Jennifer Meredith, Esq.; Lippes, Mathias, Wexler, Friedman, LLP

(57) ABSTRACT

A roofing system, comprising: at least one underlayment roll having a top and a bottom, a first end and a second end and being impermeable to moisture, wherein the bottom has an adhesive layer applied to it; wherein the first end of the underlayment roll is fastened over a center of a top rib in a roof deck and the underlayment roll is roll dispensed in a first row and cut at the end of the roof deck creating a cut end and fastened at the cut end; and wherein a second row of the underlayment roll is positioned overlapping the first row and dispensed in a second row and cut at the end of the roof deck creating another cut end and fastened at the cut end.

27 Claims, 14 Drawing Sheets

(56) References Cited

U.S. PATENT DOCUMENTS 5,479,753 A * 1/1996 Williams ..... E04D 3/38 52/411
6,050,042 A * 4/2000 Durachko ..... E04D 5/12 52/314
6,250,036 B1 6/2001 Nurley
6,454,889 B1 * 9/2002 Hendrix ..... B29B 15/125 156/307.7
7,987,647 B2 8/2011 Rymell
2002/0170254 A1 * 11/2002 Ritland ..... B32B 25/14 52/408
2003/0070391 A1 * 4/2003 Tachauer ..... A44B 18/0049 52/745.21
2004/0003563 A1 * 1/2004 Burdic ..... E04D 13/16 52/408
2005/0097828 A1 * 5/2005 Hasse ..... E04D 5/12 52/60
2006/0096218 A1 * 5/2006 Johnson ..... E04D 12/002 52/506.01
2007/0266660 A1 * 11/2007 Davies ..... E04D 5/12 52/309.1
2008/0028708 A1 * 2/2008 Albora ..... E04D 12/002 52/408
2009/0107073 A1 * 4/2009 Kalkanoglu ..... B32B 15/08 52/411
2009/0255201 A1 * 10/2009 Kraus, Jr. ..... B29C 39/18 52/309.5
2009/0293375 A1 * 12/2009 Schroer ..... E04D 13/1618 52/90.1
2011/0146199 A1 * 6/2011 Ferrante ..... E04D 1/04 52/745.06
2012/0045623 A1 * 2/2012 Delaney ..... B32B 25/10 428/189
2012/0096791 A1 * 4/2012 Cashin ..... B32B 27/12 52/309.1
2012/0233949 A1 9/2012 Brannon
2016/0177570 A1 * 6/2016 Horton ..... E04D 5/142 52/506.05

* cited by examiner

ROOFING SYSTEMS FOR LOW SLOPE MEMBRANE AND STEEP PITCH METAL ROOFING

The present invention relates to low slope roofing systems, low slope single ply roofing systems and metal roofing systems having regular to pitch slope.

Aspects of the present invention includes the Stealth Anchor and the Stealth Bond. The present application is directed to the Stealth Bond. The "Stealth Anchor" is a low Slope Roofing Fastening System. The "Stealth Bond" is a metal roofing adhesive fastening system. Low Slope Roofing is less than 2/12 to flat built up roofing. The prior art utilizes strapping in tension with fasteners placed perpendicular in shear. Both the "Stealth Anchor" and the "Stealth Bond" systems utilize the straps surface area in adhesion for tension, with the fasteners in withdrawal and also in shear. This is one of the advances in the present invention.

The Stealth anchor product would be utilized in lieu of the screw attached 3"-6" metal plates which are the current industry attachment method for low slope roofs. The stealth another provides Concealed Continuous seam roll of steel for use in attaching low-slope single-ply roofing membrane to the roof deck without using or spacing individual plates and for use as a continuous connector in the adhesive attachment of metal roofing panels to the roof deck without using exposed screws, fasteners or clips. The present invention may provide a continuous Gun Nailed Anchor Strapping System for concealed Surface Area Adhesion Connections. For Surface area adhesive structural attachment of Peel & Stick underlayment to decking thru 30# roll felt for modified ply torch down, modified bitumen membrane Low Slope roll roofing Applications. This super-efficient product is utilized in lieu of the screw attached 6" metal plates which is the current industry method. For the roll strapping attachment, ring shank nails may be a minimum of 1¼". A continuous Roll would weigh approx. 250'=61.742#.

The Stealth Bond is metal roofing panel fastener system comprised of concealed base connectors and polyurethane adhesive to attach metal roofing panels to roof decks without exposed metal panel screws, fasteners or clips. Again, the prior art utilizes strapping in tension with fasteners placed perpendicular in shear. The Stealth Bond system utilizes the same Stealth Anchor straps surface area in adhesion for surface tension, with the fasteners in withdrawal and also in shear. This is a patentable difference plus the fact that the Stealth Bond system utilizes adhesive to bond metal roofing for greater than 2/12 slopes to the Stealth Anchor. According to one embodiment, 3M's CR-20 low rise adhesive could be used or also their AH-160 Foam adhesive or ADCO Korapur 125 one part synthetic moisture-triggered polyurethane or a Korapur 330 two part synthetic epoxy-triggered adhesive to attach metal roofing to the Stealth Anchor Strap. This type metal roofing attachment system has never been conceived or accomplished until the present invention. Attached are pictures, FIGS. 3 and 4 depict concealed continuous strapping, gun nailed to decking providing an efficient structural anchor surface area for adhesive attachment of metal roofing panels.

The invention provides an innovative metal roofing concealed adhesive attachment concept. The process may be to gun nail 1 142" to 4" embossed 25 ga. Steel strapping with ring shank roofing nails 6" on center, OC, along the length of the straps that are spaced 16" to 24" on centers horizontally up the slope of the roof deck, as depicted in FIG. 5. Then applying beads of tube or foam adhesive onto the strapping and positioning metal roofing panels over and then only screwing the panels to the deck at the top and perimeter. Z closure type concealed fastened trims may be utilized for the flashings. The Strapping would provide an adequate surface to effectively adhere the metal roofing panels to the roof. This is truly a unique industry precedence setting innovation never before accomplished. The "Stealth Bond" provides a means for previously exposed screw fastened metal roofing panels to be structurally attached by concealed adhesives and strapping beneath the panel eliminating the thousands of metal roofing surface penetrating screw type fasteners.

BRIEF SUMMARY OF THE INVENTION

The present invention provides a roofing system, comprising at least one underlayment roll having a top and a bottom, a first end and a second end and being impermeable to moisture, wherein the bottom has an adhesive layer applied to it; wherein the first end of the underlayment roll is fastened over a center of a top rib in a roof deck and the underlayment roll is roll dispensed in a first row and cut at the end of the roof deck creating a cut end and fastened at the cut end; and wherein a second row of the underlayment roll is positioned overlapping the first row and dispensed in a second row and cut at the end of the roof deck creating another cut end and fastened at the cut end.

DETAILED DESCRIPTION OF THE INVENTION

Figure 2:
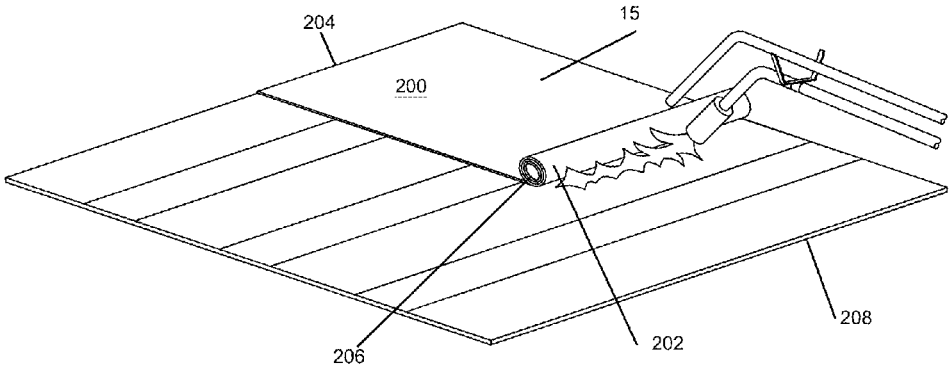
Figure 3:
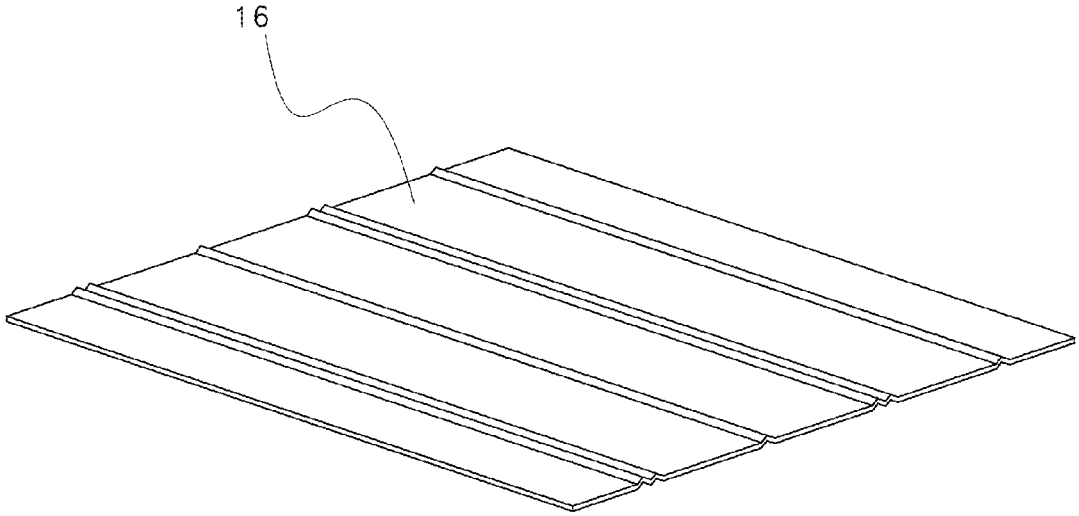
FIGS. 3 and 4 depict concealed continuous strapping gun nailed to decking providing an efficient structural anchor surface area for adhesive attachment of metal roofing panels.
Figure 4:
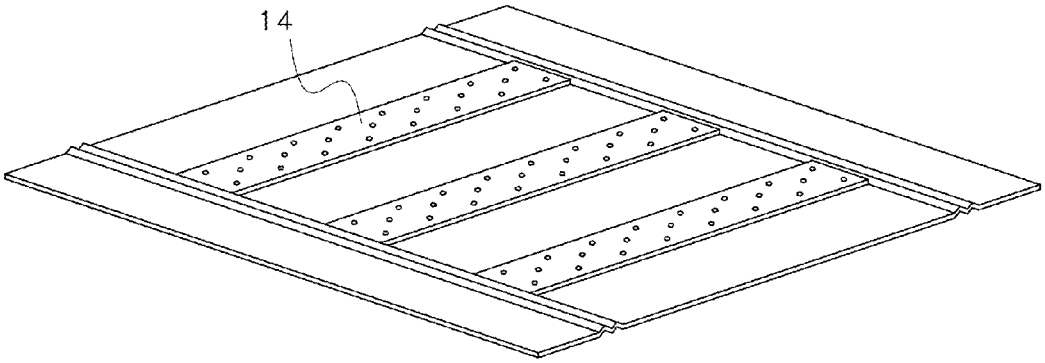

The present invention provides a roofing system, comprising: at least one underlayment roll (15) having a top (200), a bottom (202), first end (204) and a second end and being impermeable to moisture. The underlayment roll may be breathable, but does not allow moisture to permeate. The second end (206) of the roll is at the end of the roll. The first end (204) of the underlayment roll (15) is fastened over a center of a top rib in a roof deck and the underlayment roll is dispensed in a first row and cut at the end of the roof deck (208) creating a cut end (210) and fastened at the cut end. The cut end (210) may be additionally fastened by roofing gun nails (in addition to the adhesive). The adhesive layer is heat assisted. As shown in FIG. 2, a blow torch may create heat to further bond the adhesive layer. This is typically used for two part adhesives. The first end of the underlayment roll is fastened over a center of a top rib in a roof deck primarily in adhesive tension for withdrawal and also in shear.

The bottom (202) has an adhesive layer applied to it. A second row (1500) of the underlayment roll is positioned overlapping the first row (1502) and dispensed in a second row (1602) and cut at the end of the roof deck (1504) creating another cut end (1604) and fastened at the cut end. The underlayment roll may have on center fastener location markings (1506) of a predetermined length (1504). The underlayment roll is positioned overlapping a row that was previously laid down to create as many rows as are needed to entirely cover the roof deck. The at least one underlayment roll may be rolled onto a center tube for attachment to a dispensing handle.

There may be at least one strap (e.g. 1606 and 10) spaced on centers horizontally up the slope of a roof deck (12) on top of each of the at least one underlayment rolls (applied in rows) and substantially perpendicular to the first end of the underlayment roll; at least two fasteners (18) may be attached to the at least one strap and into the roof deck; at least one bead of adhesive applied to the at least one strap; at least two metal roofing panels placed on the at least one bead of adhesive applied to the at least one strap. There may be at least one strap (10) spaced on centers horizontally up the slope of a roof deck (12); at least two fasteners (18) attached to the at least one strap and into the roof deck at a top and perimeter of the at least two metal roofing panels; at least one bead of adhesive (14) applied to the at least one strap; and at least two metal roofing panels (16) placed on the at least one bead of adhesive applied to the at least one strap. The at least one strap spaced on centers horizontally up the slope of a roof deck may be steel strapping, tensile steel with a corrosion resistant barrier coating rolled tensile steel or rolled tensile steel. The at least one strap may be spaced on centers horizontally up the slope of a roof deck is attached with ring shank roofing nails. The at least one strap may have a length that is positioned perpendicular to the length of a row of the underlayment roll and spaced at a predetermined length on center. The strap may have markings to designate a gun nail on center fastener target locations. Each strap may be attached by at least two fasteners placed in two rows at a predetermined length on center along the strap. The fasteners may be in withdrawal and not in shear. At least one of the two rows of fasteners may be fastened into a wood support of the roof deck. According to one embodiment, the ring shank roofing nails are between 6 and 8 inches on center. According to one embodiment, the at least one strap is spaced between 16 and 24 inches on centers horizontally up the slope of the roof deck. The strap is used for low slope roofing, however both the flat and formed profiles are for pitched roofing Stealth Bond adhesive applications.

There may be trim along at least one edge of each of the at least two metal roofing panels, wherein the trim is attached along the at least one edge of each of the at least two metal roofing panels by a Z closure type concealed fasteners. The adhesive layer is selected from the group consisting of one part polyurethane tube adhesive and sealant, two-part polyurethane tube adhesives including no rise, medium and high rise foam versions, Butyl adhesive and sealant tube, Butyl adhesive and sealant tape, Two-part epoxies including no rise, low rise and medium rise foam adhesives, liquid nails, modified-bituminous adhesive tape and tar, TPO Adhesives, TPO self-adhering products, and non-bituminous peel and stick adhesives. The adhesive may be an urethane adhesive and sealant or a foam adhesive. Thermoplastic polyolefin (TPO) single-ply roofing membranes are among the fastest growing commercial roofing products and have gained broad industry acceptance for their many performance and installation advantages.

As shown in FIGS. 10-14, the roof deck may have a formed profile roof further comprising at least one formed anchor connector (e.g. z-closure formed profile (1000), cleat formed profile (1100), J-Channel formed profile (1200), Z-flashing profile (1300) and High-hat profile (1400)) spaced on centers (optionally substantially horizontally) up the slope of a roof deck on top of each of the at least one underlayment rolls. There may be at least two fasteners attached to the at least one formed anchor connector and at least one layer of adhesive applied to a top portion of the at least one formed anchor connector. A membrane roofing with an adhesive bottom placed on top of each of the at least one formed anchor connectors on the roof deck. The formed anchor connectors may act as alternate shapes of the structural connector which is the function of the Stealth Anchor Strapping. For Stealth Bond the adhesive can also be applied to these formed shapes to adhere roofing panels. For example, step metal shingles may use furring to elevate the endlap to create a horizontal stair stepping aesthetic appearance down the rake of the roof.

According to another embodiment, the roof deck is a formed profile roofing further comprising at least one formed anchor connector connector (e.g. z-closure formed profile (1000), cleat formed profile (1100), J-Channel formed profile (1200), Z-flashing profile (1300) and High-hat profile (1400)) spaced on centers (optionally substantially horizontal) up the slope of a roof deck on top of each of the at least one underlayment rolls. There may be at least two fasteners attached to the at least one formed anchor connector; at least one bead of adhesive applied to the at least one formed anchor connector; and at least two metal roofing panels placed on the at least one bead of adhesive applied to the at least one formed anchor connector.

The at least one strap (10) spaced on centers horizontally up the slope of a roof deck may be steel strapping. The at least one strap may be tensile steel with a corrosion resistant barrier coating. The at least one strap may also be rolled tensile steel. That is to say it may be in a continuous roll form. The at least one strap may be perpendicular to the length of the underlayment layer and spaced a predetermined length on center. For example, the at least one strap (10) may be an anchor seam roll that is 4" wide and Galvalume™ Grade 50 steel. The strap may be an anchor seam roll that may also be, for example, 29 ga. ASTM A 792, Grade 80 Class 1 Approved SS, AZ50 with a width between 1.9 and 4.1 inches and a thickness between 0.014 and 0.016 inches or 26 ga. ASTM A 792, CS Type B, AZ50 with a width between 1.9 and 4.1 inches and a thickness between 0.017 and 0.020 inches. The anchor seam roll may be a Galvalume™ or Galvanized ASTM A653 coated steel carbon acrylume ASTM A792-10 approved CS type B as coated C 0.02/0.15 mn 0.60 max P 0.30 max S 0.035 max CU 0.25 max NI 0.20 Max CR 0.15 Max MO 0.6 max V 0.008 Max Ti 0.025 Max CB 0.008 Max with the exposed prime side out and AZ50 clear organic surface treatment with dry pickle welds. According to the chemical analysis in weight % of one specimen, C=0.05, MN=0.27, P=0.006, S=0.009, SI=0.014, CU=0.01, NI=0.00, CR=0.03, MO=0.011, SN=0.008, AL=0.032, N=0.005, V=0.001, B=0.0003, TI=0.001 and CB=0.001. According to another embodiment, the anchor seam roll may be a Galvalume™ or Galvanized ASTM A653 coated steel carbon acrylume ASTM A792-10 approved CS type B as coated C 0.02/0.15 mn 0.60 max P 0.30 max S 0.035 max CU 0.25 max NI 0.20 Max CR 0.15 Max MO 0.6 max V 0.008 Max Ti 0.025 Max CB 0.008 Max with the exposed prime side out and AZ50 clear organic surface treatment with dry pickle welds. According to the chemical analysis in weight % of one specimen, C=0.05, MN=0.31, P=0.011, S=0.014, SI=0.015, CU=0.04, NI=0.01, CR=0.06, MO=0.008, SN=0.011, AL=0.040, N=0.004, V=0.002, B=0.0003, TI=0.001 and CB=0.001. According to yet another embodiment, the anchor seam roll may be a Galvalume™ or Galvanized ASTM A653 coated steel carbon acrylume ASTM A792-10 Grade 80 class 1 approved SS AS coated C 0.20 max mn 1.35 max P 0.04 max S 0.040 max CU 0.25 max NI 0.20 Max CR 0.15 Max MO 0.6 max V 0.008 Max Ti 0.025 Max CB 0.015 Max with the exposed prime side out and AZ50 clear organic surface treatment with dry pickle welds. With ok-limit 1 ys min 80 ksi 0.2% offset is min 82 ksi el dist 2 inches longitudinal ASTM std tens. According to the chemical analysis in weight % of one specimen, C=0.05, MN=0.31, P=0.006, S=0.012, SI=0.008, CU=0.03, NI=0.01, CR=0.05, MO=0.020, SN=0.004, AL=0.035, N=0.008, V=0.001, B=0.0003, TI=0.001 and CB=0.009 and SB=0.001.

Figure 1:
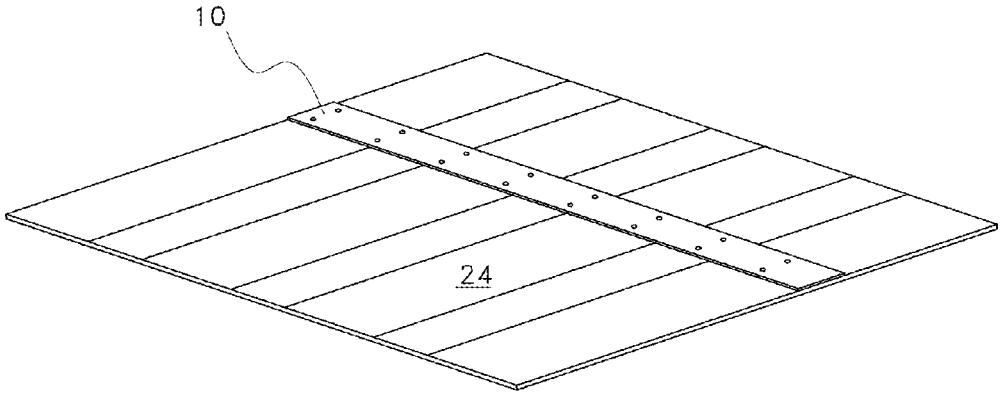
FIGS. 1 and 2 depict the Stealth anchor installation.
Figure 7:
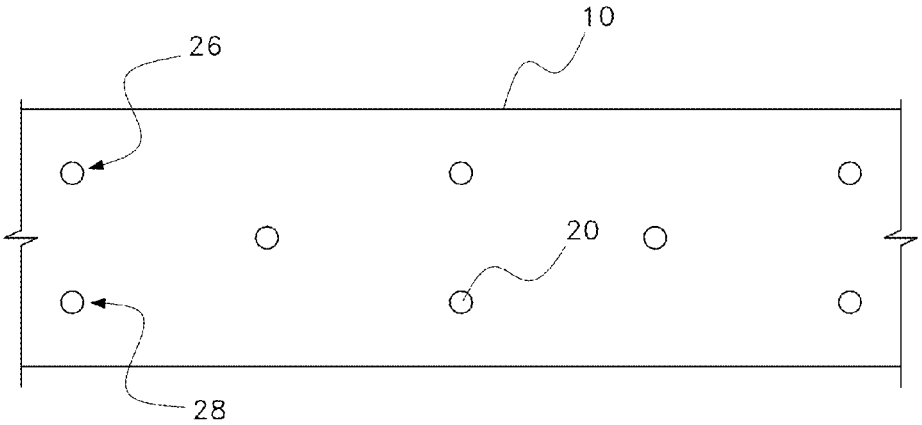
FIG. 7 depicts a Stealth Bond strap with fastening.
Figure 8:
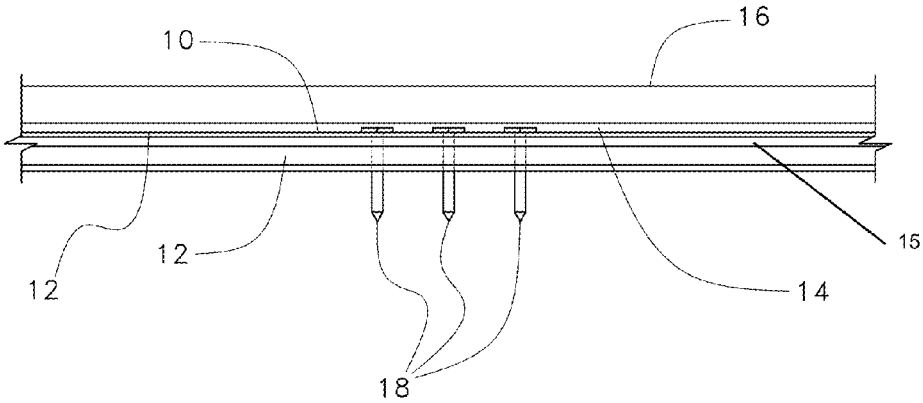
FIG. 8 depicts a Stealth Bond metal roofing adhesive.
Figure 9:
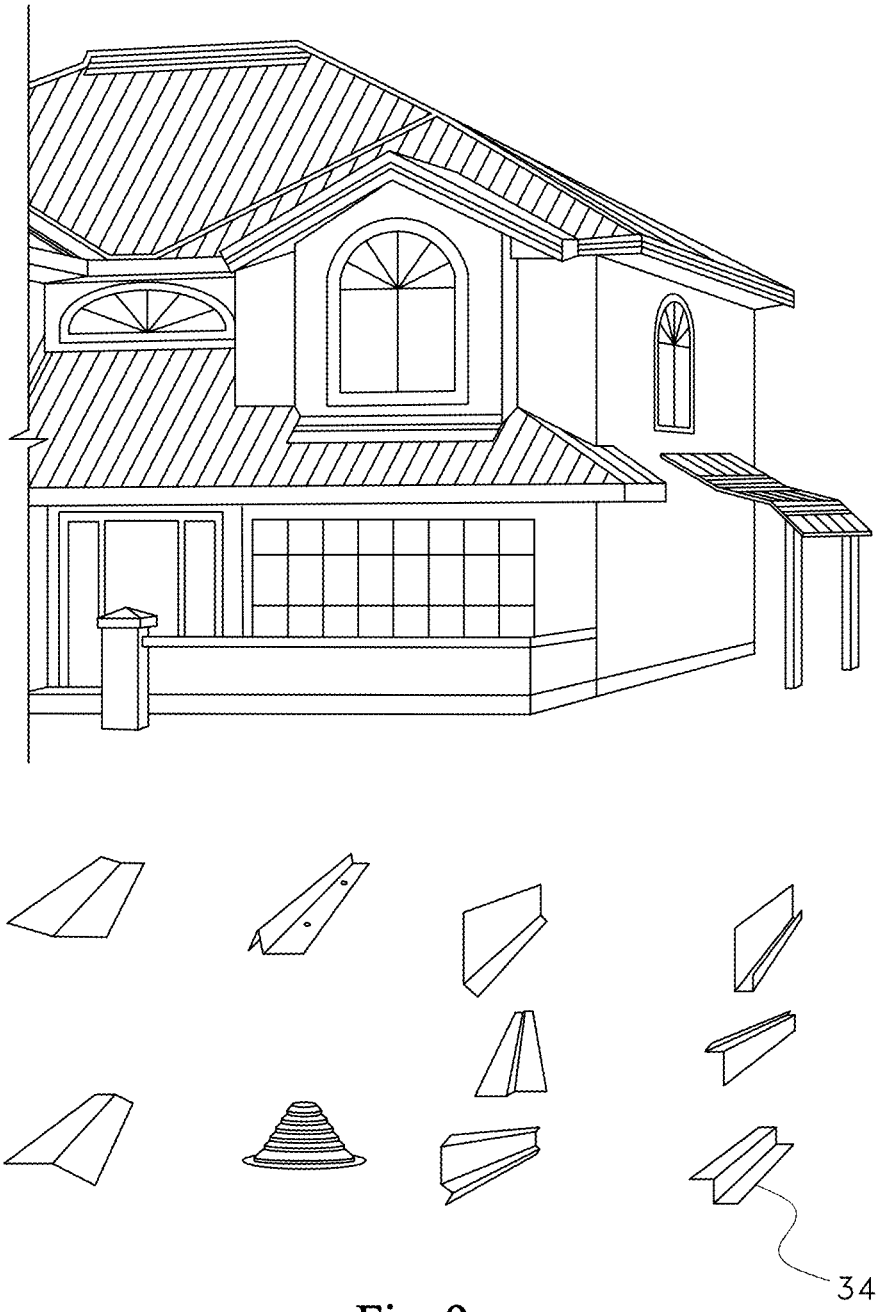
FIG. 9 depicts a Z closure type concealed fasteners.
Figure 10:
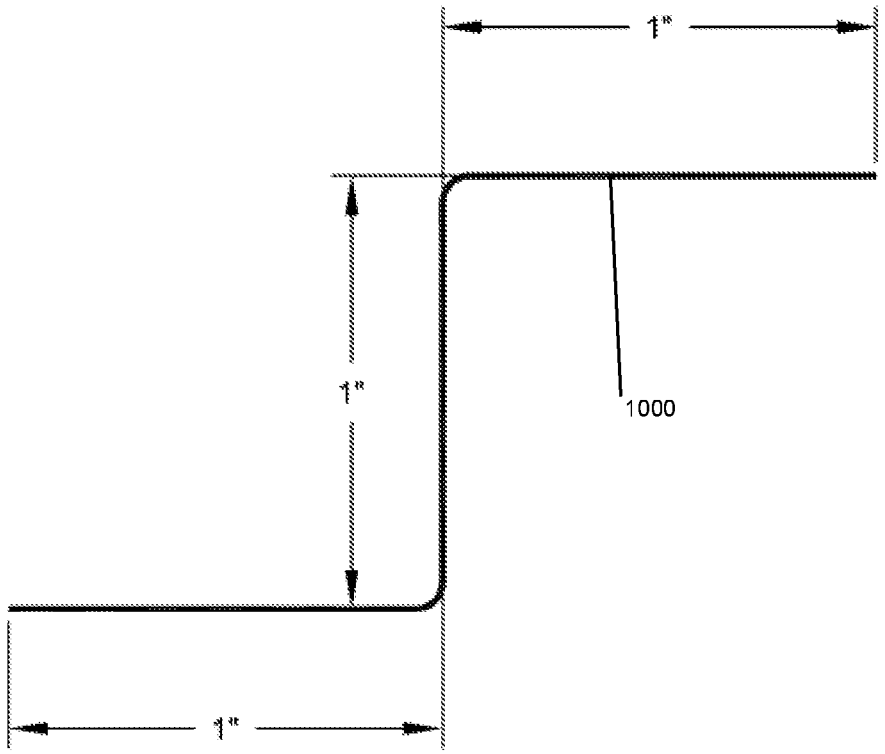
FIG. 10 depicts a Z closure type formed profile.
Figure 11:
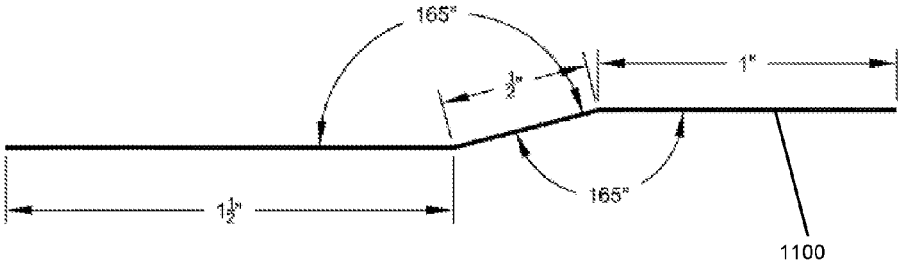
FIG. 11 depicts a cleat shaped formed profile.
Figure 12:
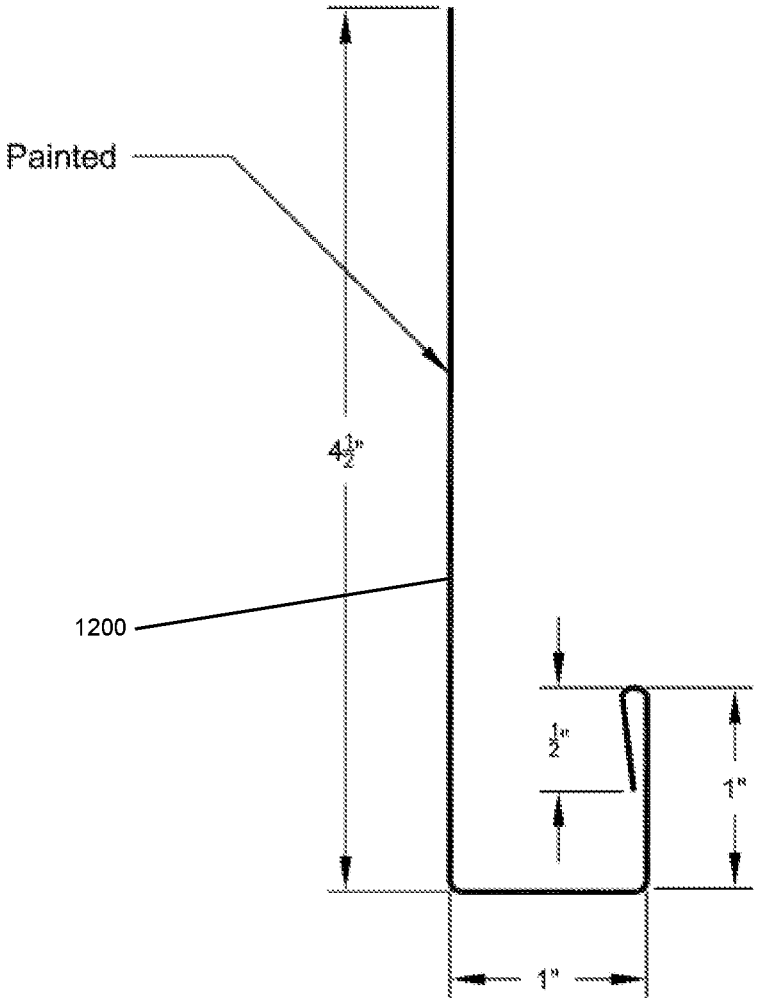
FIG. 12 depicts a J-Channel formed profile.
Figure 13:
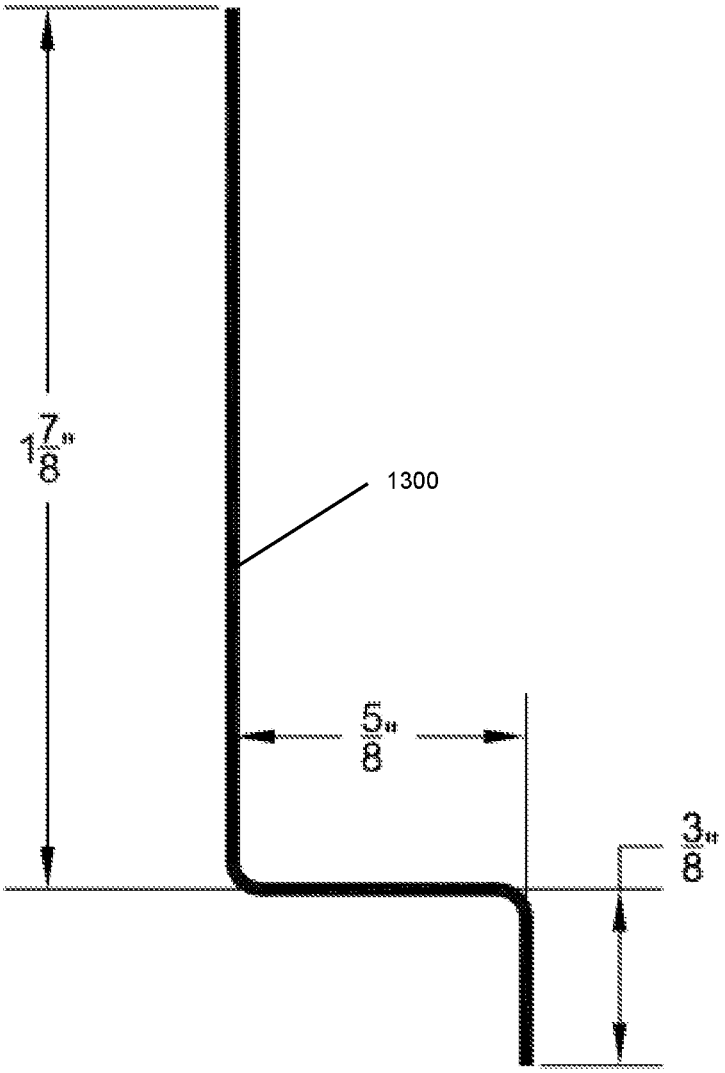
FIG. 13 depicts a Z flashing formed profile.
Figure 14:
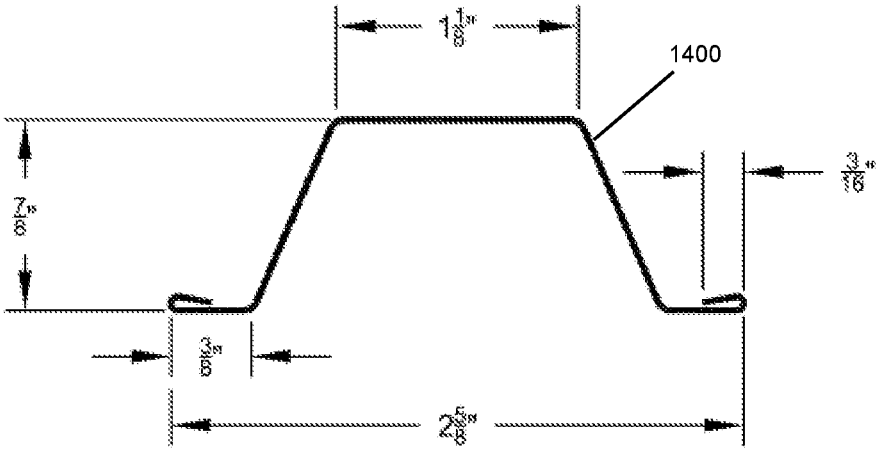
FIG. 14 depicts a hat shaped formed profile.
Figure 15:
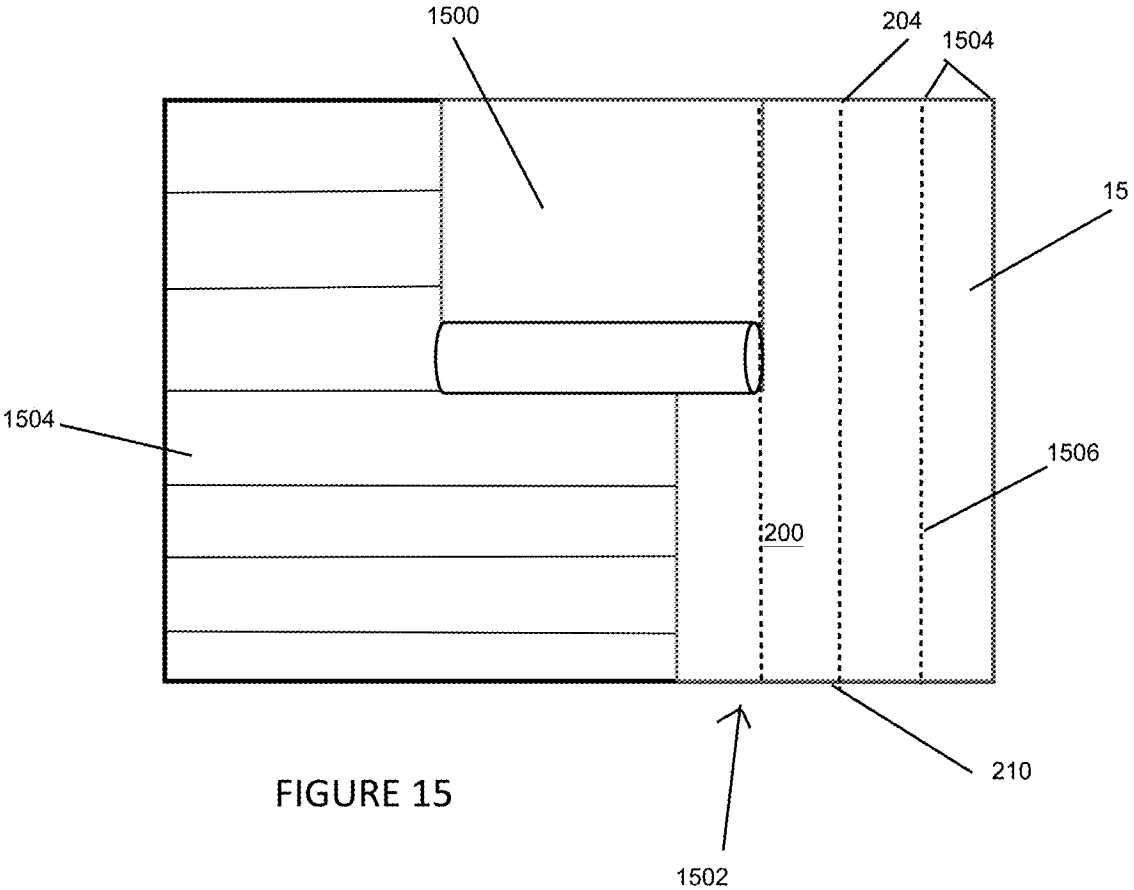
FIG. 15 depicts an underlayment roll with on center fastener location markings.
Figure 16:
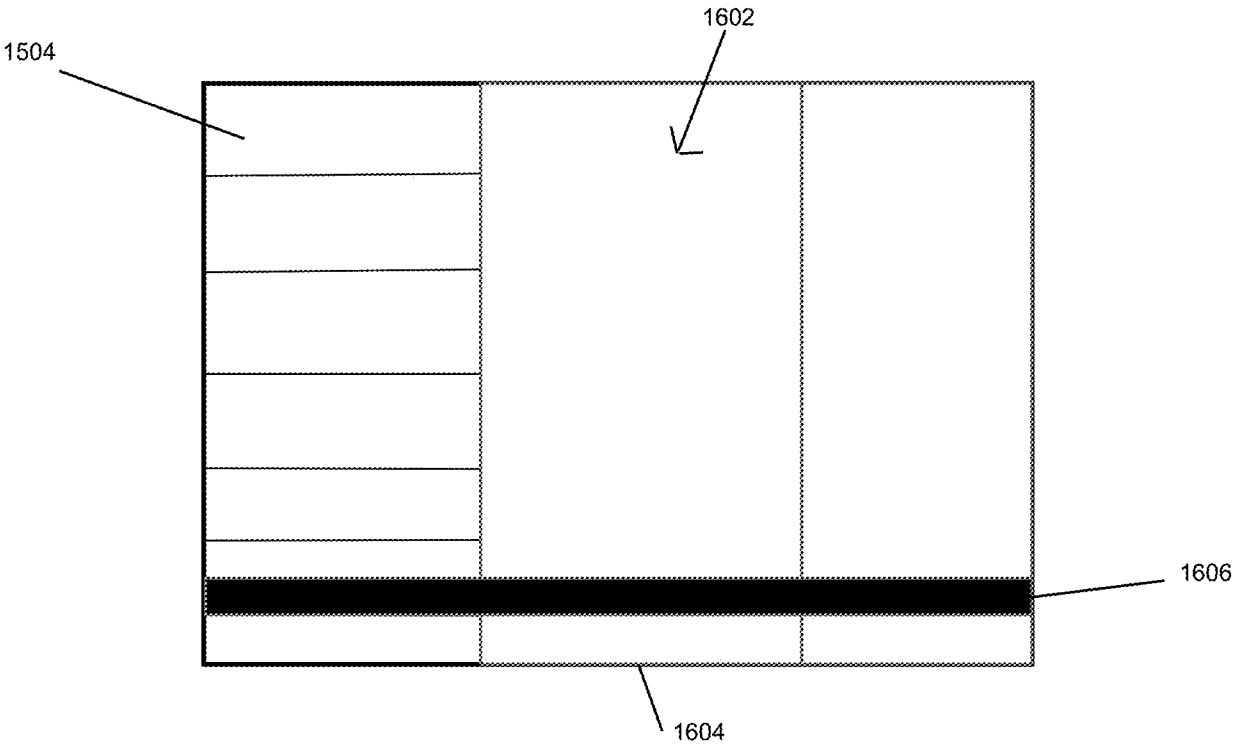
FIG. 16 depicts straps spaced on centers horizontally up the slope of a roof deck on top of each of the underlayment rolls (applied in rows) and substantially perpendicular to the first end of the underlayment roll.

As shown in FIG. 7, the at least one strap (10) may be spaced on centers horizontally up the slope of a roof deck and attached with ring shank roofing nails (20). The ring shank roofing nails may be between 6 and 8 inches on center. The at least one strap may be spaced between 12", 16" and 24" inches on centers horizontally up the slope of the roof deck. There may be trim along at least one edge of each of the at least two metal roofing panels, wherein the trim is attached along the at least one edge of each of the at least two metal roofing panels by a Z closure type concealed fasteners. FIG. 9 depicts a Z closure type concealed fastener (34). As shown in FIG. 1, the at least one strap (10) may have a length that is positioned perpendicular to the length of a base sheet (24) and spaced at a predetermined length on center. Alternatively, the at least one strap (10) may have a length that is positioned parallel to the length of a row of the underlayment roll and spaced at a predetermined length on center. Each of the at least one straps (10) may be attached by at least two fasteners placed in two rows (e.g. 26 and 28) at a predetermined length on center along the strap. At least one of the two rows (e.g. 26 and 28) of fasteners is fastened into a wood support (12) of the roof deck. The at least two fasteners may be in withdrawal and not in shear. According to one embodiment, 29 ga. Anchor straps were spaced 24 inches on center and attached perpendicular to the wood supports with 12 ga. 1¼" ring shank nails. The nails were installed in three, equally spaced staggered rows 6" o.c. and 1" from the strap edge. The 5-V crimp panels were adhered to each strap in a continuous ⅜" wide bead of Silaprene SolidSeal. The perimeter of the specimen was attached with #10-14×1½" HWH wood screws spaced 6" o.c.

There may be underlayment layer under the at least one strap and above the roof deck. The terms base sheet and underlayment layer are interchangeable. The adhesive (14) may be a urethane adhesive and sealant. The adhesive may be a foam adhesive. Typically the adhesive utilizes a one part polyurethane tube adhesive/sealant ((no or low rise caulking). Alternatively, the adhesive may be, by way of example, two-part polyurethane—including no rise, medium and high rise foam versions; Butyl adhesive/sealant tube or tape; Two-part epoxy—including no rise, low & medium rise foam adhesives; Liquid nail; Modified-bituminous adhesive tape and tar; Adhesives for TPO—the adhesives used in TPO self-adhering products and/or non-bituminous peel and stick adhesives.

Figure 5:
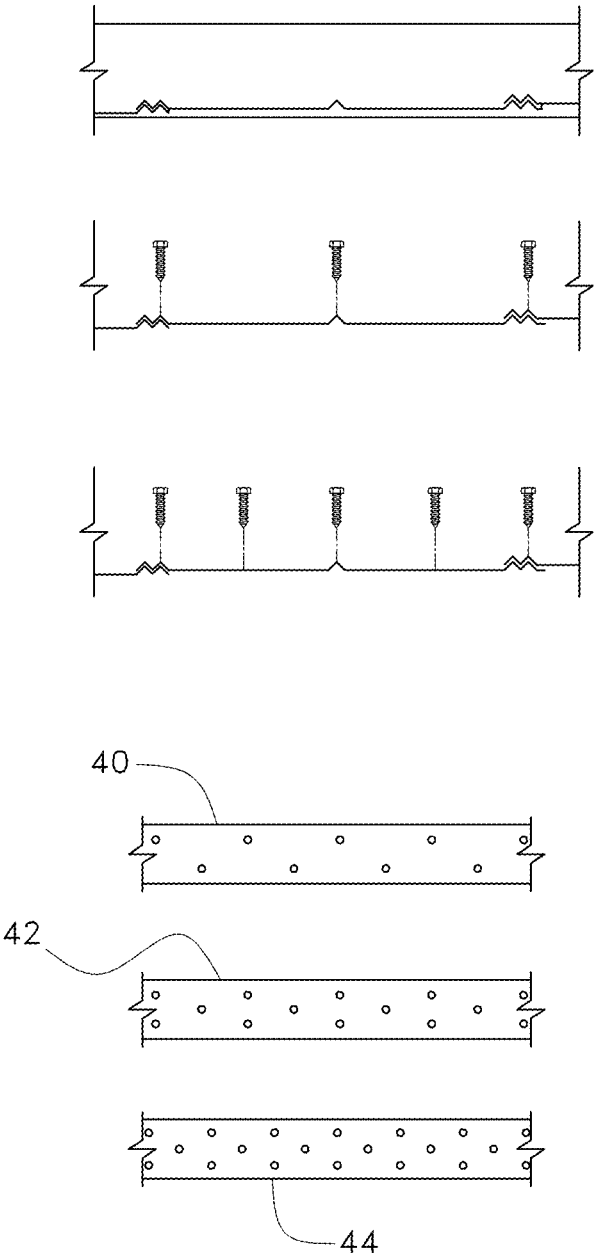
FIG. 5 depicts steel strapping with ring shank roofing nails on 6" on center, OC, along the length of the straps that are spaced 16" to 24" on centers horizontally up the slope of the roof deck.
Figure 6:
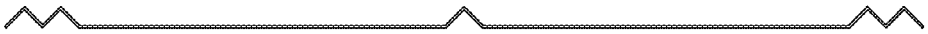
FIG. 6 depicts a 5 V crimp profile metal roofing panel.

The present invention utilizes a larger flat surface area for superior adhesion of single ply roofing system materials. The present invention utilizes rolls that are designed for use with 1¼" Ring Shank Roofing Gun Nails fasteners when mechanically attaching a single-ply roofing membrane to wood structural decks. It is easy-to roll for improved installation efficiency. The at least one strap may have markings to designate a gun nail on center fastener target locations. FIG. 5 depicts three examples of markings on straps (40, 42 and 44).

The anchor rolls may have 6-inch on center fastener location marking. A dispensing handle promotes each handling and unrolling. The Stealth anchor roll lays flat beneath the roofing membrane without wrinkles and eliminates the need to measure for accurate fastener placement. The continuous seam roll remains straight and spaced correctly for improved installation productivity. Unwinding the seam roll cuts labor when compared to individually shuffling and placing plates. Seam roll reel installation is more ergonomically friendly. To install, the at least one strap is an anchor seam roll which is positioned at the edge of the membrane. A first end is secured in position over the center of the top rib in the deck. The reel is walked along the edge of the roofing membrane dispensing the seam roll. At the end of each row, the roll is fastened in place. Roofing gun nail type fasteners are used to mechanically attach single-ply low slope roofing systems on a variety of deck types. The fasteners are attached and the anchor seam roll is unrolled along the roof membrane lap seam for proper fastener spacing. At the end of the run, the anchor seam roll is cut and the process repeated. The present invention provides a means for previously exposed screw fastened metal roofing panels to be structurally attached by concealed adhesive and base anchor connector beneath the panel eliminating thousands of metal roofing surface penetrating screw type fasteners. The system utilizes a base anchor connector's surface area for a permanent polyurethane adhesive to bond metal roofing panel systems to the roof deck. A concealed continuous anchor connector may be gun nailed to decking to provide an efficient structural anchor surface area for adhesive attachment of metal roofing panels. The system provides contractors with continuous base anchor attachment in lieu of exposed thru panel screws or clips to attach metal roofing panels systems to roof decks. The system adheres to most metal roofing panel systems, the base anchor connector includes fastener location markings. If a one-component urethane adhesive is utilized it fully cures with air within 24 hours. It may be permanently flexible to withstand movement of up to 450% of expansion and contraction with the tensile strength of the adhesive being approximately 288 psi. The system eliminates all field exposed metal roofing screws, dramatically cuts metal roofing installation time and expensive labor, eliminates the need to measure for accurate screw fastener placement, joins the metal roofing panel system material within 10 minutes, reduces corrosive staining screw shavings to sweep off, reduces the effects of cross panel tensioning (oil canning) and allows metal roofing to lay flat without screw fastener dimpling.

It should be understood that the foregoing relates to preferred embodiments of the invention and that modifications may be made without departing from the spirit and scope of the invention as set forth in the following claims.eb; normal

I claim:

1. A roofing system, comprising:

at least one underlayment roll having a top and a bottom, a first end and a second end and being impermeable to moisture;

wherein the first end of the underlayment roll is fastened to a roof deck and a first portion of the underlayment roll is roll dispensed in a first row and cut at an end of the roof deck creating a first cut end and fastened at the first cut end;

wherein a second portion of the underlayment roll is positioned overlapping the first row and roll dispensed in a second row and cut at the end of the roof deck creating a second cut end, the second cut end aligned with and fastened at the first cut end;

at least one strap spaced horizontally up a slope of the roof deck on top of each said portion of the at least one underlayment roll;

at least two fasteners attached to the at least one strap and into the roof deck;

at least one bead of adhesive applied to the at least one strap; and at least two metal roofing panels positioned on the at least one bead of adhesive applied to the at least one strap such that the fasteners do not penetrate any portion of the metal roofing panels.

2. The roofing system as in claim 1, wherein the roof deck is a formed profile roofing further comprising at least one formed anchor connector spaced on center up the slope of the roof deck on top of each said portion of the at least one underlayment roll;

at least two mechanical fasteners attached to the at least one formed anchor connector;

at least one layer of adhesive applied to a top portion of the at least one formed anchor connector; and a membrane roofing with an adhesive bottom placed on top of the at least one formed anchor connector on the roof deck.

3. The roofing system as in claim 1, wherein the roof deck is a formed profile roofing further comprising at least one formed anchor connector spaced on center up the slope of the roof deck on top of each said portion of the at least one underlayment roll;

at least two mechanical fasteners attached to the at least one formed anchor connector;

at least one adhesive bead applied to the at least one formed anchor connector; and at least two additional metal roofing panels placed on the at least one adhesive bead applied to the at least one formed anchor connector.

4. The roofing system as in claim 1, wherein the at least one underlayment roll has on center fastener location markings of a predetermined length.

5. The roofing system as in claim 1, wherein each said cut end is fastened by roofing gun nails.

6. The roofing system as in claim 1, wherein the underlayment roll is further positioned overlapping a previously laid down row to create a plurality of rows that entirely cover the roof deck.

7. The roofing system as in claim 1, wherein the adhesive is a foam adhesive.

8. The roofing system as in claim 1, wherein the at least one underlayment roll is rolled onto a center tube for attachment to a dispensing handle.

9. The roofing system as in claim 1, wherein the first end of the underlayment roll is fastened over a center of a top rib in the roof deck primarily in adhesive tension for withdrawal and also in shear.

10. The roofing system as in claim 1, wherein an adhesive layer is applied to the bottom of the at least one underlayment roll.

11. The roofing system as in claim 10, wherein the adhesive layer is selected from the group consisting of one part polyurethane tube adhesive and sealant, two-part polyurethane tube adhesives including no rise, medium and high rise foam versions, Butyl adhesive and sealant tube, Butyl adhesive and sealant tape, Two-part epoxies including no rise, low rise and medium rise foam adhesives, liquid nails, modified-bituminous adhesive tape and tar, TPO Adhesives, TPO self-adhering products, and non-bituminous peel and stick adhesives.

12. The roofing system as in claim 1, wherein the at least one strap is further spaced on centers and substantially perpendicular to the first end of the underlayment roll.

13. The roofing system as in claim 12, wherein the at least one strap is steel strapping.

14. The roofing system as in claim 12, wherein the at least one strap is spaced between 16 and 24 inches on centers horizontally up the slope of the roof deck.

15. The roofing system as in claim 12, wherein the adhesive is a urethane adhesive and sealant.

16. The roofing system as in claim 12, wherein the at least two fasteners are in withdrawal and also in shear.

17. The roofing system as in claim 12, wherein the at least one strap is tensile steel with a corrosion resistant barrier coating.

18. The roofing system as in claim 12, wherein the at least one strap is rolled tensile steel.

19. The roofing system as in claim 12, wherein the at least one strap has markings to designate a gun nail on center fastener target locations.

20. The roofing system as in claim 12, further comprising trim positioned along at least one edge of each of the at least two metal roofing panels, wherein the trim is attached along the at least one edge of each of the at least two metal roofing panels by Z closure concealed fasteners.

21. The roofing system as in claim 12, further comprising trim positioned along at least one edge of each of the at least two metal roofing panels, wherein the trim is attached along the at least one edge of each of the at least two metal roofing panels by one or more Z closure concealed fasteners.

22. The roofing system as in claim 12, wherein the at least one strap is attached with ring shank roofing nails.

23. The roofing system as in claim 22, wherein the ring shank roofing nails are located between 6 and 8 inches on center.

24. The roofing system as in claim 12, wherein the at least one strap comprises a plurality of straps, and each said strap is attached by at least two fasteners placed in two rows at a predetermined length on center along the respective strap.

25. The roofing system as in claim 24, wherein at least one of the two rows of fasteners is fastened into a wood support of the roof deck.

26. The roofing system as in claim 12, wherein the at least one strap has a length that is positioned perpendicular or parallel to a length of a respective said row of the underlayment roll and spaced at a predetermined length on center.

27. The roofing system as in claim 26, wherein the at least one strap is perpendicular to the length of the respective row of the underlayment roll and spaced the predetermined length on center.

* * * * *